US011946110B2

(12) United States Patent
Lloyd et al.

(10) Patent No.: US 11,946,110 B2
(45) Date of Patent: Apr. 2, 2024

(54) MANUFACTURED TWINNING IN METAL STRUCTURES FOR IMPROVED DAMAGE TOLERANCE

(71) Applicant: U.S. Army Combat Capabilities Development Command, Army Research Labortary, Adelphi, MD (US)

(72) Inventors: Jeffrey T. Lloyd, Aberdeen, MD (US); Phillip A. Jannotti, Baltimore, MD (US); Daniel J. Magagnosc, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 480 days.

(21) Appl. No.: 16/925,697

(22) Filed: Jul. 10, 2020

(65) Prior Publication Data

US 2022/0010391 A1 Jan. 13, 2022

(51) Int. Cl.

| | |
|---|---|
| ***C21D 7/10*** | (2006.01) |
| ***C22F 1/06*** | (2006.01) |
| ***C22F 1/18*** | (2006.01) |

(52) U.S. Cl.

CPC ..... *C21D 7/10* (2013.01); *C22F 1/06* (2013.01); *C22F 1/183* (2013.01)

(58) Field of Classification Search

CPC ..... C21D 7/10; C22F 1/06; C22F 1/183

See application file for complete search history.

(56) References Cited

U.S. PATENT DOCUMENTS

| | | | | |
|---|---|---|---|---|
| 8,505,353 | B2 | 8/2013 | Park et al. | |
| 2012/0111081 | A1* | 5/2012 | Park | C22F 1/06 72/362 |
| 2014/0348696 | A1 | 11/2014 | Park et al. | |

OTHER PUBLICATIONS

Lee et al. ("Enhancing yield strength by suppressing detwinning in a rolled Mg—3Al—1Zn alloy with {101¯2} twins." Materials Science and Engineering: A 619 (2014): 328-333.) (Year: 2014).*

Hong, S., et al., "Role of {10-12} twinning characteristics in the deformation behavior of a polycrystalline magnesium alloy," Acta Materialia 58, Jul. 30, 2010, pp. 5873-5885.

Zhang, H., et al., "Improved formability of Mg—3Al—1Zn alloy by pre-stretching and annealing," Scripta Materialia, 67, Jun. 16, 2012, pp. 495-498.

Park, S., et al., "Enhanced stretch formability of rolled Mg—3Al—1Zn alloy at room temperature by initial {10-12} twins," Materials Science and Engineering A, 578, May 2, 2013, pp. 271-276.

Lee, J., et al., "Enhancing yield strength by suppressing detwinning in a rolled Mg—3Al—1Zn alloy with {I0$\bar{1}$2} twins," Materials Science and Engineering A, 619, Oct. 5, 2014, pp. 328-333.

(Continued)

*Primary Examiner* — Ricardo D Morales
(74) *Attorney, Agent, or Firm* — Alan I. Kalb

(57) ABSTRACT

A metal structure includes an alloy material containing structural deformation twins embedded during a manufacturing process of the alloy material along defined directions, a defined deformation sequence, and defined strain levels. The embedded structural deformation twins mitigate failure and fracture in the alloy material.

12 Claims, 6 Drawing Sheets

(56) References Cited

OTHER PUBLICATIONS

Wu, W., et al., "Understanding low-cycle fatigue life improvement mechanisms in a pre-twinned magnesium alloy," Journal of Alloys and Compounds, 656, Oct. 3, 2015, pp. 539-550.
Wang, L., et al., "Improved Stretch Formability of AZ31 Magnesium Thin Sheet by Induced {10-12} Tension Twins," JOM, vol. 70, No. 10, Jul. 17, 2018, pp. 2321-2326.

* cited by examiner

MANUFACTURED TWINNING IN METAL STRUCTURES FOR IMPROVED DAMAGE TOLERANCE

GOVERNMENT INTEREST

The embodiments herein may be manufactured, used, and/or licensed by or for the United States Government without the payment of royalties thereon.

BACKGROUND

Technical Field

The embodiments herein generally relate to material science technologies, and more particularly to manufacturing techniques for producing improved metal structures using mechanically deformed alloy materials.

Description of the Related Art

Magnesium alloys have high specific strength and stiffness, which suggests they are a promising lightweight metal for structural and military applications such as personnel and vehicle armor; however, they have limited ductility compared to aluminum alloys that gives rise to severe spalling and discing, and correspondingly poor ballistic performance. Conventionally, deformation is used to increase the strength of materials at the expense of fracture toughness and ductility. Cast products are deformed to fairly large strains (e.g., 30-100%) to increase their strength for appropriate ballistic performance, where a balance of strength, fracture toughness, and ductility are achieved.

Discing can occur when a penetrator travels through the target structure and approaches the rear face of the target. The back face of the target undergoes bending and is put in a state of tension, which causes lateral cracks to propagate and ultimately separates the back face of the material to fracture and eject out. Spalling is a similar phenomenon, where the back face of the material fractures and is ejected; however, the main distinction is that spalling can occur before the penetrator reaches the back face. Both phenomena degrade the ballistic performance of materials. Other methods to improve the ballistic performance of magnesium are generally expensive such as the introduction of expensive rare-earth elements and/or severe plastic deformation.

SUMMARY

In view of the foregoing, an embodiment herein provides a metal structure comprising an alloy material containing structural deformation twins embedded during a manufacturing process of the alloy material along defined directions, a defined deformation sequence, and defined strain levels, wherein the embedded structural deformation twins mitigate failure and fracture in the alloy material. The alloy material may comprise magnesium. The alloy material may comprise beryllium. The alloy material may comprise titanium. The alloy material may comprise twinning-induced plasticity (TWIP) steel. The mitigation of the dynamic fracture may comprise reduced discing and spalling of the alloy material upon penetrating impact. The defined direction may comprise a plate rolling direction of the alloy material. The defined direction may comprise a plate transverse direction of the alloy material. The defined direction may comprise a plate normal direction of the alloy material. The defined strain level may be between 3-15%. The defined strain level may be between 6-12%.

Another embodiment provides a method of manufacturing comprising providing an alloy material and embedding structural deformation twins during manufacturing of the alloy material along defined directions, a defined deformation sequence, and at defined strain levels of the alloy material, wherein the embedded structural deformation twins mitigate failure and fracture in the alloy material. The defined deformation sequence may comprise compressing the alloy material during manufacturing. The defined deformation sequence may comprise compression along a plate transverse direction of the alloy material. The defined strain level during the compression along the plate transverse direction of the alloy material may be approximately 6%. The defined deformation sequence may comprise compression along a plate transverse direction and then compression along a plate rolling direction of the alloy material. The defined strain level during the compression along the plate transverse direction of the alloy material may be approximately 6%, and the defined strain level during the compression along the plate rolling direction of the alloy material may be approximately 3%. The defined strain level during the compression along the plate transverse direction of the alloy material may be approximately 6%, and the defined strain level during the compression along the plate rolling direction of the alloy material may be approximately 6%. The embedding of the structural deformation twins may occur during any step of the manufacturing.

Another embodiment provides an alloy material for production of a metal structure prepared by a process which comprises providing a manufacturing apparatus; providing an alloy material in the manufacturing apparatus; compressing the alloy material to create embedded structural deformation twins along defined directions, a defined deformation sequence, and at defined strain levels of the alloy material; and removing the alloy material from the manufacturing apparatus, wherein the embedded structural deformation twins mitigate failure and fracture in the alloy material.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
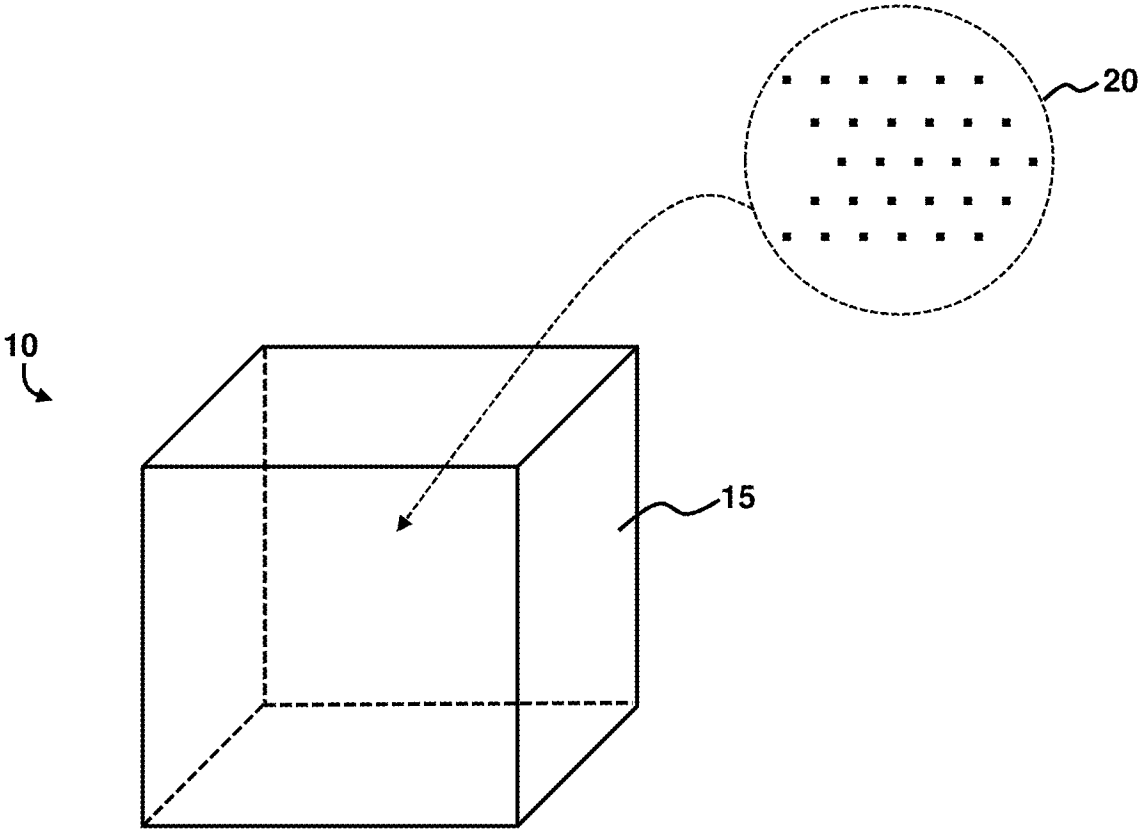
FIG. 1 is a schematic diagram illustrating a metal structure, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide techniques for pre-straining alloy materials, whereby deformation twins are deliberately introduced into the microstructure during the manufacturing process. Experimental ballistic testing demonstrates that the velocity required to penetrate magnesium alloys in pre-strained samples is approximately 15% greater than conventional wrought magnesium alloys. Additionally, the extent of discing and spalling in the ballistically impacted samples is greatly reduced due to the pre-straining method provided by the embodiments herein, which may be due to increases in ductility and dynamic fracture toughness. More particularly, the techniques provided by the embodiments herein intentionally deform alloy materials, such as materials containing magnesium, along specified directions, sequences, and to particular strain levels in order to impart deformation twins into the material. Experimental specimens that were pre-deformed exhibited improved ballistic performance as compared with the parent (non-deformed) material. In addition, the pre-deformed samples exhibited reduced occurrence of fracture and failure after it was impacted ballistically, which suggests the pre-deformed specimens possess superior dynamic fracture properties compared to the parent material. Referring now to the drawings, and more particularly to FIGS. 1 through 6B, where similar reference characters denote corresponding features consistently throughout the figures, there are shown preferred embodiments. In the drawings, the size and relative sizes of components, layers, and regions, etc. may be exaggerated for clarity.

FIG. 1 illustrates a metal structure 10 comprising an alloy material 15 containing structural deformation twins 20 embedded during a manufacturing process of the alloy material 15 along defined directions, a defined deformation sequence, and defined strain levels. In FIG. 1, the offsetting arranging of dots in the encircled area represent the cooperated displacement of atoms along the face of a twin boundary. However, the embodiments herein are not restricted to this particular type of orientation of the deformation twins 20. The metal structure 10 may comprise any suitable shape or configuration. According to an example, the metal structure 10 may be configured as a plate. More particularly, the metal structure 10 may be configured as a wrought plate. As further described below, the defined directions may be the plate normal direction (ND), the plate rolling direction (RD), or the plate transverse direction (TD). Additionally, as further described below, the sequence of the deformation sequence may be controlled by providing compressive forces on the metal structure 10 selectively based on the defined directions (ND, RD, or TD). For example, the sequence may involve applying compressive forces along one of the defined directions, sequentially in a combination of two or more defined directions, or simultaneously along two or more defined directions. Additionally, the duration of applying the compressive forces may be selected based on the material properties of the alloy material 15 to ensure strength characteristics are properly maintained during the compression. In other examples, the deformation of the alloy material 15 may occur through torsional deformation, or a combination of compressive and torsional deformation. The deformation process creates a displacement of atoms in the alloy material 15.

In an example, the defined strain level may be between 3-15% compared to the non-strained level of the alloy material 15. More specifically, in an example, the defined strain level may be between 6-12% compared to the non-strained level of the alloy material 15. The embedded structural deformation twins 20 mitigate failure and fracture in the alloy material 15 by causing changes in the crystalline structure of the alloy material 15, and more particularly by enhancing the material strength or ductility characteristics of the crystalline structure of the alloy material 15. In an example, the alloy material 15 may comprise magnesium. In some other examples, the alloy material 15 may comprise beryllium, titanium, twinning-induced plasticity (TWIP) steel, or other suitable metal material. For example, the metal structure 10 may be a wrought magnesium plate. Wrought magnesium products exhibit a strong basal texture. Pre-straining the metal structure 10 to introduce twins 20 is provided in accordance with the embodiments herein to improve ballistic performance by mitigating the fracture behavior in the form of discing and spalling on the back face of the target metal structure 10.

The mitigation of the dynamic fracture may comprise reduced discing and spalling of the alloy material 15 upon penetrating impact of the metal structure 10 by a ballistic penetrator (not shown) or by other cause of impact on the metal structure 10.

In rolled magnesium products the crystal c axis is aligned with the plate normal direction (ND). Deformation that extends the crystal c axis produces deformation twins 20, which in this case are {10-12} extension twins. Therefore, compression along plate rolling direction (RD) or plate transverse direction (TD) produces twins 20. Moreover, different twin morphologies can be created by controlling the extent and sequence of deformation. Plate-like morphologies are observed under uniaxial compression along the RD or TD, whereas crossing twin morphologies are observed under sequential compression along the TD and the RD. Deformation along these directions is shown schematically in FIG. 2, with reference to FIG. 1. As indicated, the defined direction may comprise a plate rolling direction RD of the alloy material 15. Moreover, the defined direction may comprise a plate transverse direction TD of the alloy material 15. Furthermore, the defined direction may comprise a plate normal direction ND of the alloy material 15. As such, the deformation twins 20 embedded during the manufacturing processes of the alloy material 15 may occur in any of the RD, TD, and ND directions, and in any selected sequence.

Figure 2:
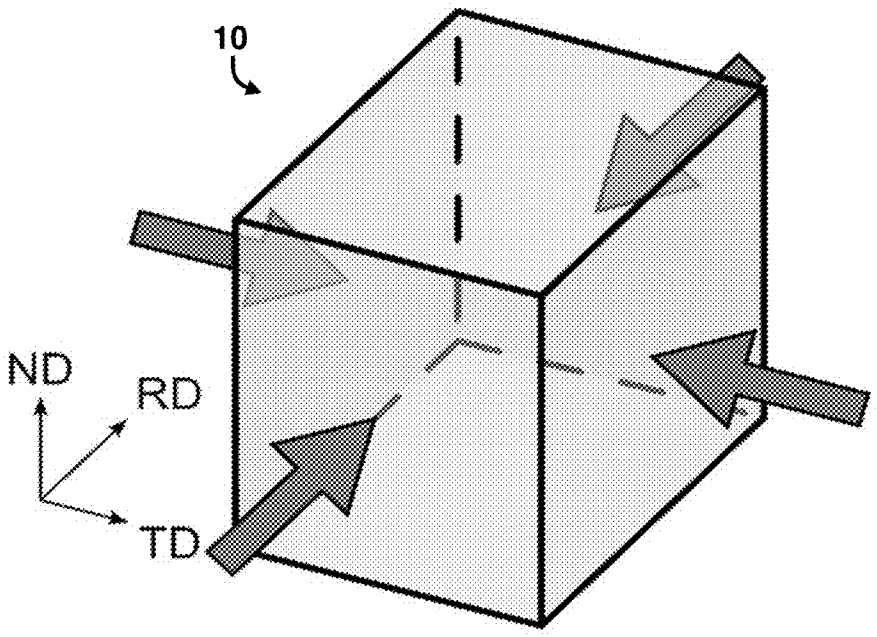
FIG. 2 is a schematic diagram illustrating deformation directions to induce twinning under compressive loads in a rolled plate such as the metal structure of FIG. 1, with directions indicated by rolling direction (RD), transverse direction (TD), and plate normal direction (ND), according to an embodiment herein.
Figure 3:
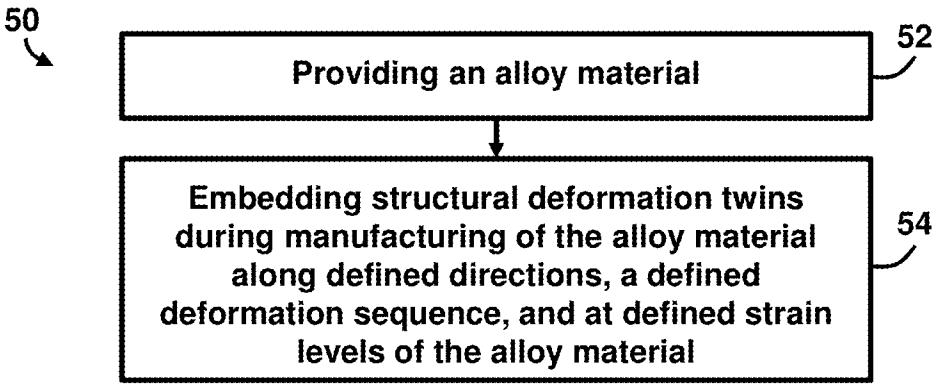
FIG. 3 is a flow diagram illustrating a method of manufacturing the metal structure of FIG. 1, according to an embodiment herein.

FIG. 3, with reference to FIGS. 1 and 2, is a flow diagram illustrating a method of manufacturing 50 comprising providing (52) an alloy material 15. As described above, the alloy material 15 may comprise any suitable metal material. For example, the alloy material 15 may comprise any of magnesium, beryllium, and titanium. Moreover, the alloy material 15 may comprise any suitable initial form, shape or configuration. In an example, the alloy material 15 may be in the form of a plate. Next, the method of manufacturing 50 comprises embedding (54) structural deformation twins 20 during manufacturing of the alloy material 15 along defined directions, a defined deformation sequence, and at defined strain levels of the alloy material 15. In an example, the structural deformation twins 20 are created by compressing the alloy material 15. Accordingly, the embedded structural deformation twins 20 mitigate failure and fracture in the alloy material 15 by improving the strength or ductility characteristics of the crystalline structure of the alloy material 15 due to shape changes of the crystals caused by displacement of the atoms. In an example, the embedding of the structural deformation twins 20 may occur during any step of the manufacturing process. For example, the structural deformation twins 20 may be embedded during a compression step of the alloy material 15, which may occur before, during, or after other material forming and finishing steps occur.

As described above, the defined deformation sequence that causes the embedding of the structural deformation twins 20 in the alloy material 15 may comprise compressing the alloy material 15 during manufacturing (referred to herein as pre-deformed). Furthermore, the defined deformation sequence may comprise compression along a plate transverse direction TD of the alloy material 15. In an example, the defined strain level during the compression along the plate transverse direction TD of the alloy material 15 may be approximately 6%. In a first example of the defined deformation sequence, the defined deformation sequence may comprise compression along a plate transverse direction TD and then compression along a plate rolling direction RD of the alloy material 15. In a second example of the defined deformation sequence, the defined strain level during the compression along the plate transverse direction TD of the alloy material 15 may be approximately 6%, and the defined strain level during the compression along the plate rolling direction RD of the alloy material 15 may be approximately 3%. In a third example of the defined deformation sequence, the defined strain level during the compression along the plate transverse direction TD of the alloy material 15 may be approximately 6%, and the defined strain level during the compression along the plate rolling direction RD of the alloy material 15 may be approximately 6%. According to various examples, the strain level may be measured using any suitable device such as an electrical strain gauge or an optical strain sensor.

Figure 4:
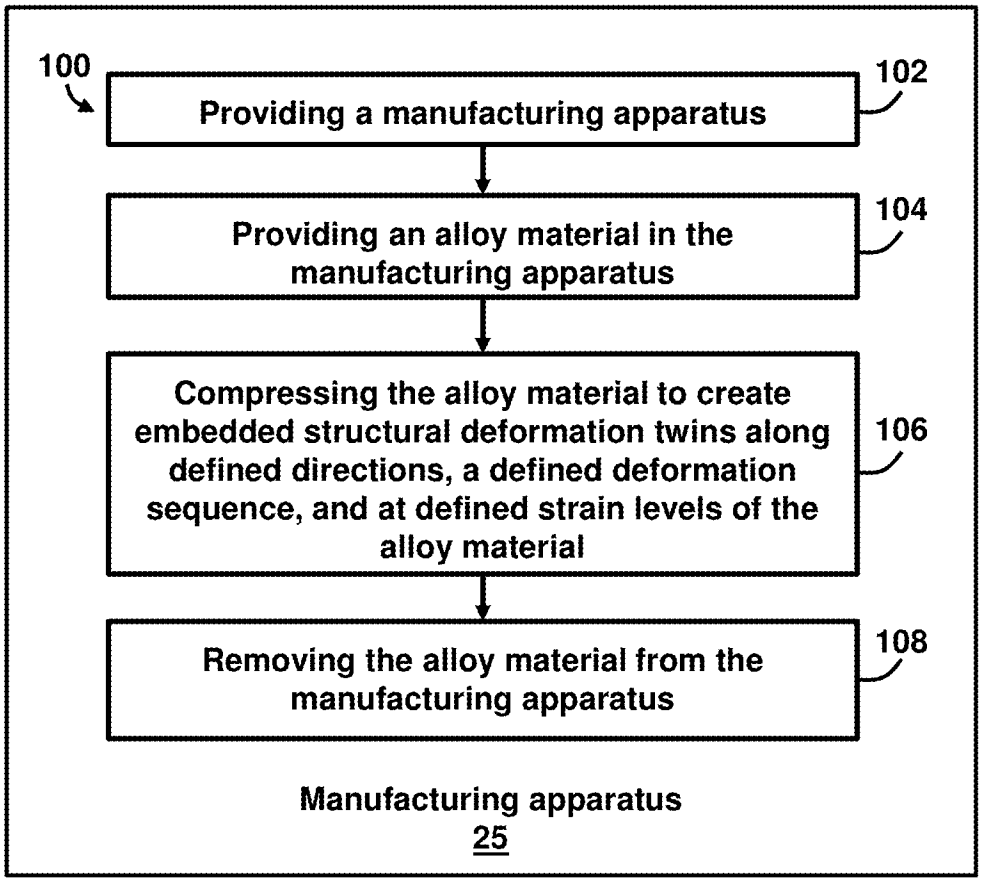
FIG. 4 is a flow diagram illustrating a process of preparing an alloy material for production of the metal structure of FIG. 1, according to an embodiment herein.

Another embodiment provides an alloy material 15 for production of a metal structure 10 in a manufacturing apparatus 25, wherein the metal structure 10 is prepared by a process 100 illustrated in the flow diagram of FIG. 4, with reference to FIGS. 1 through 3. The manufacturing apparatus 25 may be a typical apparatus or multiple apparatuses arranged in a system to form and deform the alloy material 15. In an example, the manufacturing apparatus 25 may contain a hydraulic press or other machine tool that provides a compressive force on the metal structure 10 to create the deformation twins 20.

The process 100 comprises providing (102) a manufacturing apparatus 25, and positioning or providing (104) an alloy material 15 in the manufacturing apparatus 25. The manufacturing apparatus 25 may be automated and/or utilize user intervention. Additionally, the positioning or providing of the alloy material 15 in the manufacturing apparatus 25 may also be an automated process and/or it may include user intervention. Next, the process 100 comprises compressing (106) the alloy material 15, using the manufacturing apparatus 25, to create embedded structural deformation twins 20 along defined directions, a defined deformation sequence, and at defined strain levels of the alloy material 15. The compressive forces may be controlled at selected levels based on the type of alloy material 15 and the desired strength characteristics of the metal structure 10, which may be based on the application or use of the metal structure 10. Thereafter, the process 100 comprises removing (108) the alloy material 15 from the manufacturing apparatus 25. Again, this may be an automated process and/or may involve user intervention. The embedded structural deformation twins 20 mitigate failure and fracture in the alloy material 15. Additionally, the process 100 can be used as an inexpensive final processing step for manufacturing the metal structure 10 to drastically improve the fracture properties of the metal structure 10.

Experiment

The specific parameters, values, amounts, ranges, materials, types, brands, etc. described below are approximates and were merely selected for the experiments, and as such the embodiments herein are not limited to the specific descriptions below. Wrought magnesium plates are deformed to targeted levels of deformation, and along specific directions (ND, TD, and/or RD) to introduce a desired twin morphology prior to ballistic testing. Unlike conventional techniques to improve the ballistic performance of wrought products, the pre-deformation (i.e., during the manufacturing process 100) improves the fracture behavior of the metal structure 10 under ballistic loads. Consequently, the ballistic performance of experimental samples that have been pre-strained/pre-deformed to introduce twins 20 exhibit superior ballistic performance and reduced spalling and discing after ballistic impact compared with the reference wrought parent (i.e., no pre-formed deformations) material.

The extensive experimental ballistic testing demonstrates an improvement in the ballistic performance due to the introduction of the twins 20 (pre-twinning). In fact, the ballistic performance has been found to exceed that of the parent material for three processing routes utilizing pre-twinning, denoted as Process 1, 2, and 3, as described in Table 1. The ballistic limit was found for 0.30-caliber Fragment Simulating Projectile (FSP) using the standard, well-known V-50 test methodology protection criteria in accordance with MIL-STD-662F. This represents the velocity at which the probability that a projectile defeats an armor as defined by MIL-STD-662F is 50%. In this experimental testing, complete penetration is defined by placing a 0.020 in. (0.51 mm) thick sheet of aluminum alloy (2024-T3) 6.5 inches (165 mm) behind and parallel to the target and observing whether or not the aluminum sheet has been perforated.

TABLE 1

Ballistic limit results for the parent material and three processing routes utilizing pre-twinning

| Material | Protection Ballistic Limit (m/s) |
|---|---|
| Parent | 515 ± 14 |
| Process 1 | 548 ± 7 |
| Process 2 | 565 ± 7 |
| Process 3 | 581 ± 7 |

The ballistic performance of the three pre-processed plates, and the reference parent plate are included in Table 1. It is shown that the V-50 results of all three pre-twinned plates are superior to the parent plate. In a ballistic test, a target is impacted by a fragment simulating projectile. The impacted specimen exhibits lateral cracking and discing after impact. Despite arresting the projectile, a significant portion of the back face of the target plate is ejected during impact of the projectile upon the target. When discing occurs, specimens viewed from the back face exhibit a large circular area of missing material.

Experimentally, the ballistic behavior of the three plates that are processed to produce a pre-twinned morphology are examined (i.e., in accordance with Process 1, 2, and 3). The deformation sequences are given in Table 2. Sequential deformation for pre-twinning was carried out by compression 3-inch cubes to the indicated strain levels using a one-million-pound hydraulic press as the manufacturing apparatus 25. The strains were determined via the crosshead displacement and verified by measuring the deformed cubes. The pre-compressed cubes were subsequently machined to 0.6-inch thick plates approximately 3 inches×3 inches wide for ballistic testing.

TABLE 2

Deformation sequences to produce pre-twinned plates

| Material | Deformation sequence |
|---|---|
| Process 1 | 6% compression along TD |
| Process 2 | 6% compression along TD, then 3% compression along RD |
| Process 3 | 6% compression along TD, then 6% compression along RD |

During ballistic impact, if discing or spalling occurs it is observed on the back face of the plate. A large delaminated area around the penetration cavity is indicative of failure occurring. Despite increasing velocity for complete penetration, the damaged area is reduced for the three pre-processed materials (i.e., in accordance with Process 1, 2, and 3 described above in Table 2). Normally, increasing velocity would correspond to increased damage area. This confirms that the improvement in ballistic properties is tied to the improved dynamic fracture resistance of pre-twinned plates.

Figure 5B:
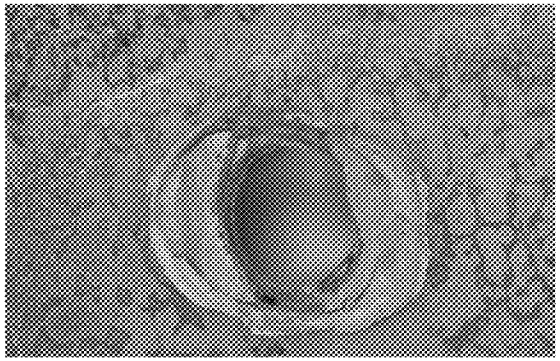
FIG. 5B is a photograph of the back face of a metal plate manufactured with deformation twins according to a first process, and after being impacted by a 0.30 cal fragment simulating projectile at 549 m/s, according to an embodiment herein.
Figure 5D:
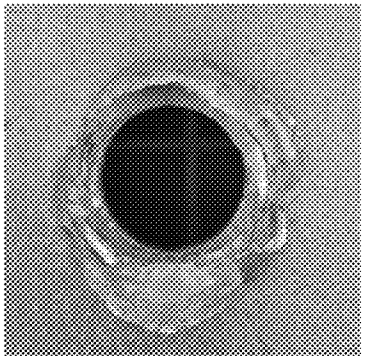
FIG. 5D is a photograph of the back face of a metal plate manufactured with deformation twins according to a third process, and after being impacted by a 0.30 cal fragment simulating projectile at 573 m/s, according to an embodiment herein.
Figure 5A:
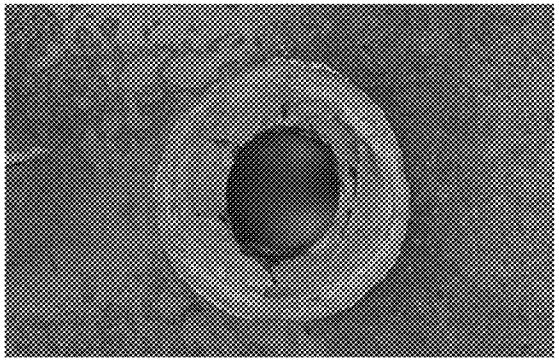
FIG. 5A is a photograph of the back face of a metal plate manufactured without deformation twins, and after being impacted by a 0.30 cal fragment simulating projectile at 520 m/s, according to an embodiment herein.
Figure 5C:
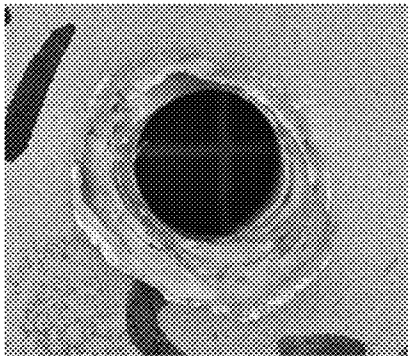
FIG. 5C is a photograph of the back face of a metal plate manufactured with deformation twins according to a second process, and after being impacted by a 0.30 cal fragment simulating projectile at 570 m/s, according to an embodiment herein.

As shown in FIGS. 5A through 5D, the back faces of various plates are shown after they were impacted by a 0.30 cal FSP. The parent material is shown in FIG. 5A and the materials formed by Processes 1 through 3, described above, are shown in FIGS. 5B through 5D, respectively. The impact velocity corresponds to the minimum velocity at which complete penetration occurred. Even though the penetration velocity increases progressively from the parent material (520 m/s) to Processes 1 (549 m/s), 2 (570 m/s), and 3 (573 m/s), the damaged zone on the back face reduces in size. This reduction in damaged area; i.e., spall and discing, may be responsible for the increase in ballistic performance.

Experimentally, the wrought magnesium plates that were pre-strained to introduce deformation twins 20 into the microstructure of the alloy material 15 exhibit superior ballistic performance compared with the parent material. The deformation twins 20 were introduced by pre-compressing magnesium specimens along the rolling (RD) and transverse (TD) directions to specified strain levels in order to produce a desired twin morphology. Despite only experimentally investigating three pre-straining routes, all pre-strained specimens showed improvement in ballistic performance, as measured by the V-50 procedures, with one technique (Process 3) showing almost 15% improvement over the parent material. In addition to possessing superior ballistic performance, the pre-strained specimens showed little evidence of fracture and failure behavior after ballistic testing. This is in contrast with most lightweight metals; e.g., magnesium, aluminum, and titanium that are not pre-strained, all of which experience significant discing and spalling after similar ballistic testing.

Figure 6B:
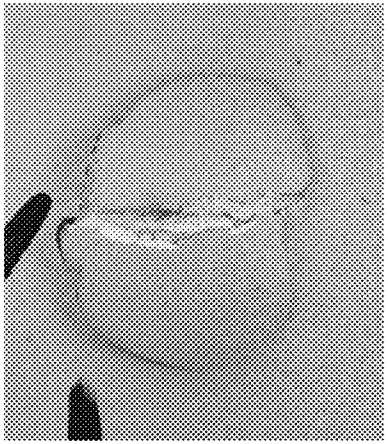
FIG. 6B is a photograph of the back face of a metal plate manufactured with deformation twins according to a third process, and after being impacted by a 0.30 cal fragment simulating projectile at 545 m/s, according to an embodiment herein.
Figure 6A:
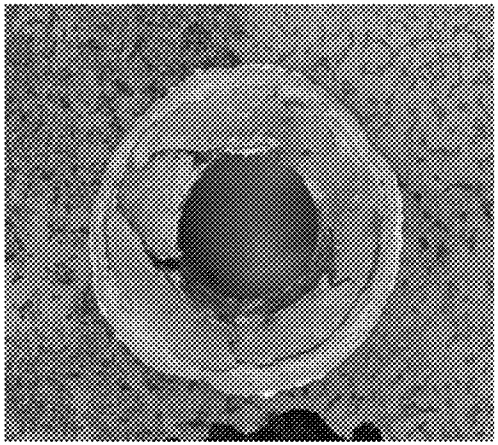
FIG. 6A is a photograph of the back face of a metal plate manufactured without deformation twins, and after being impacted by a 0.30 cal fragment simulating projectile at 545 m/s, according to an embodiment herein.

A clear distinction in the improved fracture behavior under ballistic loads is shown in FIGS. 6A and 6B, where the reference parent material and Process 3 material were impacted at identical velocities of 545 m/s. Complete penetration occurs for the parent material whereas the projectile is arrested for the Process 3 material. Additionally, the Process 3 material does not exhibit discing and spalling, and instead exhibits normal back face deflection and cracking, thereby demonstrating improved material characteristics and impact mitigation compared to the non-deformed (i.e., no twins) parent material.

The techniques provided by the embodiments herein present a paradigm shift where small targeted strains (e.g., 3-15%) are imposed along specific directions to introduce deformation twins 20 in the alloy material 15. In this regard, pre-twinning only requires relatively small strains (3-15%) compared to normal strain hardening processes that employ much greater strains (30-100%). For all cases experimentally investigated, the introduction of deformation twins 20 was shown to improve ballistic performance, with experimental results demonstrating an improvement being approximately 15% over the non-pre-strained parent material. Additionally, the introduction of twins 20 was shown to drastically reduce (instead of increase) the extent dynamic fracture in the form of discing and spalling during ballistic impact. Moreover, pre-twinning can be applied to thick wrought products and sections.

The embodiments herein have multiple commercial and non-commercial applications. Some applications include ballistic protection of personnel armor and vehicles, etc.; personnel armor or part of a personnel armor package;

vehicle hull armor or applique armor package for ballistic protection; vehicle hull armor or applique armor package for blast protection; damage resistant, lightweight structural component for unmanned ground or aerial vehicles; automotive structural components for improved collision performance; damage tolerant consumer electronics packaging; improved damage tolerance of wrought products; and damage tolerant biomedical implants, among other commercial and non-commercial, including military, uses and applications.

By improving the ballistic performance in an alloy material 15, such as magnesium alloys, these alloys may meet or exceed the weight required for similar protection levels in other metals such as aluminum, titanium, and steel. Typically, deforming a material is shown to reduce its fracture toughness and ductility, whereas the techniques provided by the embodiments herein uses deformation to increase the resistance to dynamic fracture behavior.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A metal structure comprising:

an alloy material comprising magnesium containing structural deformation twins embedded during a manufacturing process of the alloy material along defined directions, a defined deformation sequence, and defined strain levels, wherein the embedded structural deformation twins are present as a result of pre-compressing in two directions and said twins are in multiple directions and intersecting said pre compressing in two directions of defined strain levels being greater than 5% strain.

2. The structure of claim 1, wherein the mitigation of the dynamic fracture comprises reduced discing and spalling of the alloy material upon penetrating impact.

3. The structure of claim 1, wherein the defined direction comprises a plate rolling direction of the alloy material.

4. The structure of claim 1, wherein the defined direction comprises a plate transverse direction of the alloy material.

5. The structure of claim 1, wherein the defined direction comprises a plate normal direction of the alloy material.

6. A method of manufacturing comprising:

providing an alloy material; and embedding structural deformation twins during manufacturing of the alloy material along defined directions, a defined deformation sequence, and at defined strain levels of the alloy material, wherein the embedded structural deformation twins mitigate failure and fracture in the alloy material and are present as a result of pre-compressing in two directions and said deformation twins are in multiple directions and intersecting said pre compressing in two directions of defined strain levels being greater than 5% strain.

7. The method of claim 6, wherein the defined deformation sequence comprises compressing the alloy material during manufacturing.

8. The method of claim 7, wherein the defined deformation sequence comprises compression along a plate transverse direction of the alloy material.

9. The method of claim 6, wherein the defined deformation sequence comprises compression along a plate transverse direction and then compression along a plate rolling direction of the alloy material.

10. The method of claim 9, wherein the defined strain level during the compression along the plate transverse direction of the alloy material is approximately 6%, and wherein the defined strain level during the compression along the plate rolling direction of the alloy material is approximately 3%.

11. The method of claim 9, wherein the defined strain level during the compression along the plate transverse direction of the alloy material is approximately 6%, and wherein the defined strain level during the compression along the plate rolling direction of the alloy material is approximately 6%.

12. The method of claim 6, wherein the embedding of the structural deformation twins occurs during any step of the manufacturing.

* * * * *